United States Patent [19]

Klay

[11] 4,182,528

[45] Jan. 8, 1980

[54] DOOR LOCK

[76] Inventor: William F. Klay, 541 Seale Ave., Palo Alto, Calif. 94301

[21] Appl. No.: 829,127

[22] Filed: Aug. 30, 1977

[51] Int. Cl.[2] ..... E05C 1/12

[52] U.S. Cl. ..... 292/169.17; 70/451

[58] Field of Search ..... 292/165, 169, 169.14, 292/169.17, 169.19, 34, 37, 159, 140; 70/152, 448, 451, DIG. 80

[56] References Cited

U.S. PATENT DOCUMENTS

| | | | |
|---|---|---|---|
| 1,423,825 | 7/1922 | Anderson | 70/451 |
| 1,462,805 | 7/1923 | Gibson | 292/140 |
| 1,748,599 | 2/1930 | Dermody | 292/169.14 |
| 1,792,154 | 2/1931 | Farmer | 292/165 X |
| 2,330,011 | 9/1943 | Schlage | 292/169.17 X |
| 2,568,273 | 9/1951 | Clark | 292/169.14 X |
| 3,666,306 | 5/1972 | Genakis | 292/169.17 |
| 3,948,066 | 4/1976 | Solovieff | 292/165 X |

*Primary Examiner*—J. Franklin Foss
*Attorney, Agent, or Firm*—Townsend & Townsend

[57] ABSTRACT

A door lock including a support member formed from a pair of spaced, generally parallel sides and an end wall interconnecting the sides. A shiftable, spring biased lock bolt is carried between the sides and movable through an opening in the end wall and into locked relationship to a door strike when the door is closed. Several embodiments of the structure for moving the lock bolt away from the door strike are disclosed including the following: a rotatable shaft having a knob at each end and provided with a projection extending into a recess in the lock bolt; a pair of L-shaped levers pivotally mounted on respective sides of the support member and having respective pins in respective slots of the door lock bolt; and a shiftable plate projecting laterally from the sides of the support member and having a pin received within a camming slot through the lock bolt.

2 Claims, 10 Drawing Figures

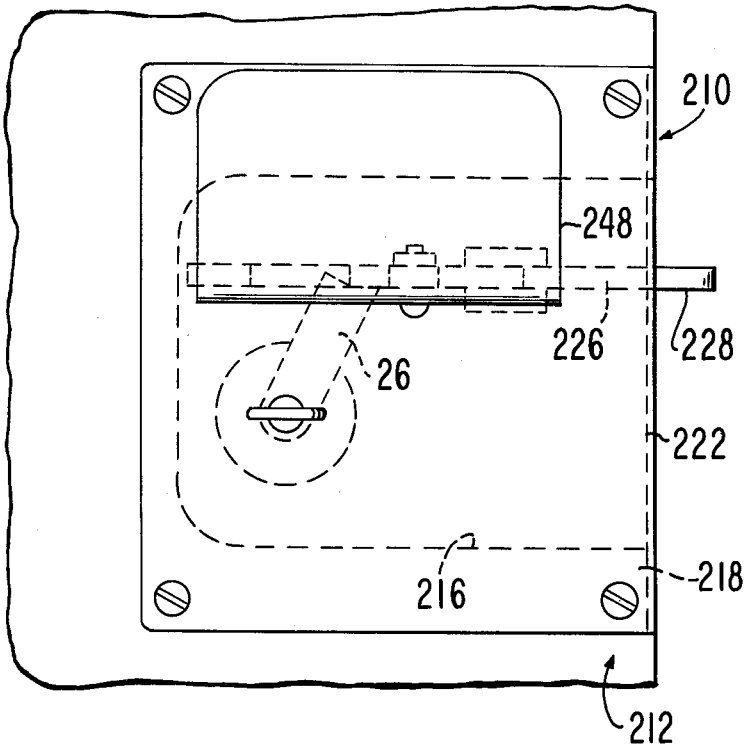
FIG. 5
FIG. 6
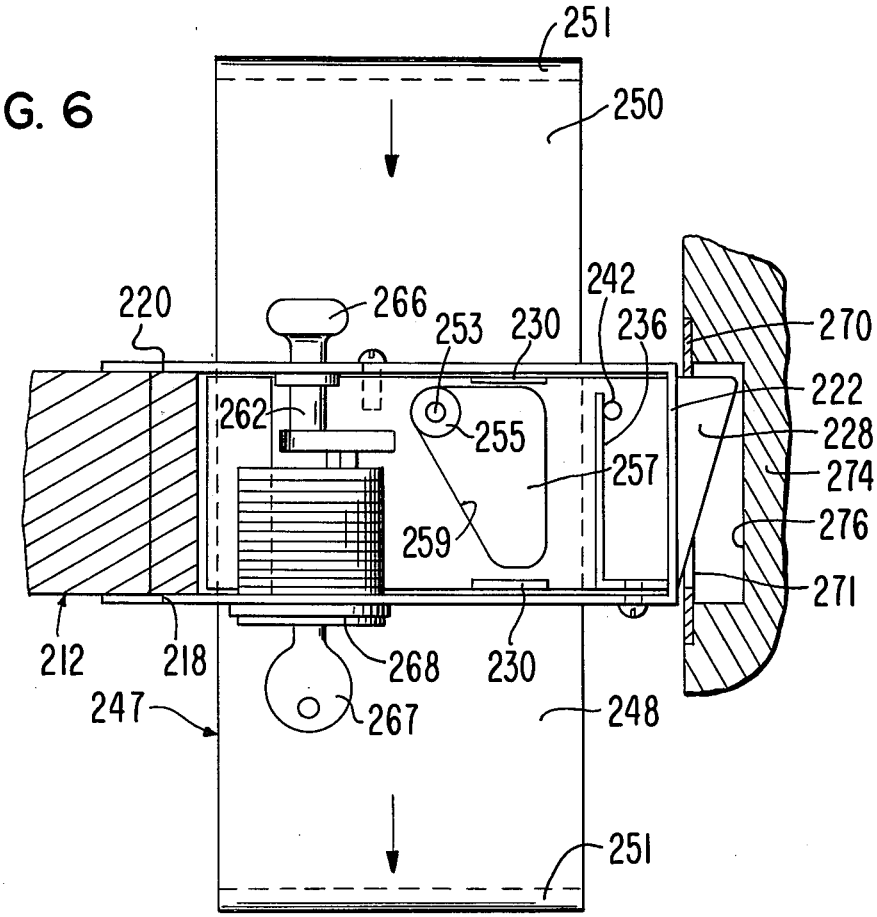

DOOR LOCK

This invention relates to improvements in door locks and, more particularly, to a door lock having a minimum of parts to simplify manufacturing, assembly and installation.

BACKGROUND OF THE INVENTION

In modern day door locks and latches, it is necessary to drill a door through the sides thereof and through the end face to insert and mount the various parts, such as the side plates, the door knob and shaft and the bolt. Typically, this requires some skill and effort on the part of the installer. Moreover, the complexity of the installed parts requires smooth interaction between the parts and, therefore, increased production costs.

While attempts have been made to simplify such door locks and mechanisms, such attempts have for the most part not been too successful because they have not been made to minimize assembly of parts and to decrease production costs of the parts and the lock assembly. Thus, a need has arisen for an improved lock for a door which is simple and rugged in construction, is made of a relatively few number of parts and can be installed with a minimum of skill and dexterity.

SUMMARY OF THE INVENTION

The present invention satisfies the aforesaid need by providing a lock of simple construction and one which can be quickly and easily assembled even by a person of minimum or substantially no mechanical skills. To this end, the lock of this invention includes a U-shaped support member comprised of a pair of generally rectangular, flat, parallel sides interconnected by a flat end wall so that the member can fit over the edge of the door after the door has been cut to form a recess or open space therein. The sides can be mounted by screws into the door and the edge wall typically is mortised in the edge and face of the door.

A lock bolt of plate-like construction is shiftably mounted between the sides and moves through an opening in the end wall so that one end of the lock bolt can project laterally from the member and into the opening in a door strike mounted on a door jamb when the door is closed. The lock bolt is shiftably mounted between a pair of vertically spaced guides secured to the inner surface of each side, respectively, so that the lock bolt can shift from an operative position projecting laterally and outwardly from the end wall to a retracted position within the end wall, thereby clearing the door strike and permitting the door to open. A spring between the sides engages a projection on the lock bolt and biases it into its operative or locked position.

Several embodiments of the structure for shifting the lock bolt out of the operative position can be used, if desired. For instance, one embodiment includes a shaft extending through the sides and having a lateral arm or projection thereon extending into a milled recess in the lock bolt so that, as the shaft is rotated, the arm moves in the recess and causes the lock bolt to shift into the space between the sides and thereby into its retracted position. Knobs on the end of the shaft can be provided to facilitate the rotation of the shaft.

Another embodiment of such structure includes a pair of L-shaped levers pivotally mounted intermediate their ends on respective ears projecting laterally from respective sides. Each lever extends through a slot in the corresponding side so that a segment of the lever extends into the recess and is coupled by a pin to the lock bolt inasmuch as the pin is received within a slot extending transversely of the longitudinal axis of the lock bolt. Thus, by pushing on one lever or pulling on the other lever, the lock bolt is caused to move into its retracted position against the bias force of the spring which biases it into its extended or operative position.

Another way of making the structure of the type described is to use a plate which extends through the sides of the support member and projects laterally therefrom with the plate having a pin extending into a slot in the lock bolt, the slot having an inclined edge so that the pin and inclined edge form a cam arrangement which causes the lock bolt to shift into the retracted position when one side of the plate is pushed toward the door or the other side of the plate is pulled away from the door.

In all embodiments, means is provided to hold the lock bolt in its locked or operative position. To this end, this includes an arm which rotates within the space between the two sides, the arm being carried by a shaft which must be rotated either from the inside by rotating the knob or from the outside by rotating the key in a cylinder lock.

The primary object of this invention is to provide an improved lock for a door which has a relatively few number of parts, is simple to assemble and inexpensive to produce as well as easy to install to thereby minimize the cost and effort of making and installing such a lock yet provide the positive locking advantages of more expensive, complex door locks.

Another object of this invention is to provide a door lock of the type described, wherein a lock bolt of simple construction is shiftably mounted between a pair of spaced sides capable of readily being mounted on the sides of the door with the lock bolt being movable through a slot in an end wall interconnecting the sides so that structure within the space between the sides and accessible from the regions exteriorly of the sides can be operated to move the lock bolt out of its operative position to permit opening of the door, all of which can be accomplished with a relatively few parts yet the door lock can be installed with substantially little or no skill in a minimum of time.

Other objects of this invention will become apparent as the following specification progresses, reference being had to the accompanying drawings for several embodiments of the invention.

IN THE DRAWINGS:

FIG. 5 is a view similar to FIGS. 1 and 3 but showing a third embodiment of the lock of this invention;

FIG. 6 is a view similar to FIGS. 2 and 4 but showing a top plan view of the lock of FIG. 5;

Figure 1:
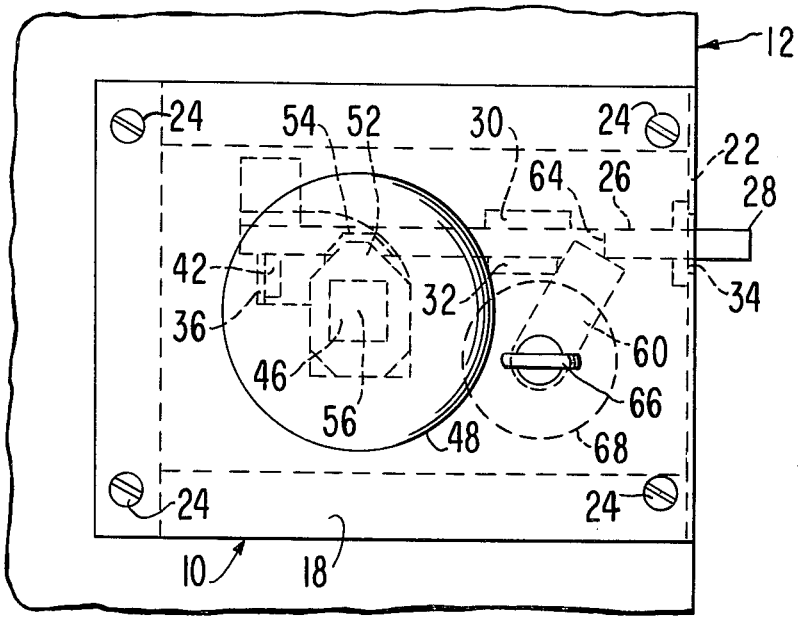
FIG. 1 is a side elevational view of one embodiment of the lock of the present invention.

The first embodiment of the lock of this invention is broadly denoted by the numeral 10 and is adapted to be used on a door 12 of wood or other materials which is cut along the jamb face 14 thereof to form a rectangular recess 16 denoted by dashed lines in FIG. 1. Thus, the recess forms a space for receiving a lock 10 and to allow it to operate in an unrestricted manner.

Lock 10 includes a U-shaped support member formed from a pair of opposed sides 18 and 20, and an end wall 22 interconnecting sides 18 and 20. Sides 18 and 20 are larger than the side dimensions of recess 16 so that the sides 18 and 20 can be secured by screws 24 to the opposed sides of door 12.

A lock bolt 26 having an outer end 28 is shiftably mounted between sides 18 and 20 by guides 30 and 32 above and below lock bolt 26, guides 30 and 32 being secured in any suitable manner to the inner surfaces of respective sides 18 and 20.

End wall 22 has an opening 34 therethrough for receiving the outer end 28 of lock bolt 26. Thus, the lock bolt can move from the full line or locked position of FIGS. 1 and 2 to a retracted position in which outer end 28 is within recess 16 or at least inwardly of the outer face of end wall 22.

A leaf spring 36 having a base 38 is secured by a screw 40 to the inner surface of side 18. Spring 36 normally engages a projection 42 secured to and extending downwardly from lock bolt 26 near the inner end thereof. Spring 36 biases lock bolt 26 into the full line position thereof shown in FIG. 1. A stop 37 limits the outward travel of the lock bolt by engaging the inner surface of end wall 22 when outer end 28 projects laterally therefrom as shown in FIG. 2.

Means for moving lock bolt 26 inwardly includes a door knob unit 44 including a shaft 46 extending through a pair of aligned holes through sides 18 and 20, the shaft having knobs 48 and 50 attached thereto. Shaft 46 has a lateral projection 52 which is received within a milled recess 54 in the bottom of lock bolt 26. This recess is spaced outwardly from the axis 56 of rotation of shaft 46 so that, as one of the knobs is rotated to rotate shaft 46, projection 52 is moved to, in turn, cause movement of lock bolt 26. For instance, when shaft 46 is rotated in a counterclockwise sense when viewing FIG. 2, lock bolt 26 is moved from right to left and outer end 28 moves into recess 16 at least until outer end 28 clears the outer face of end wall 22. Thus, this would allow the door to be opened since the lock bolt would not extend into a door strike or mortised recess behind such a strike.

Figure 2:
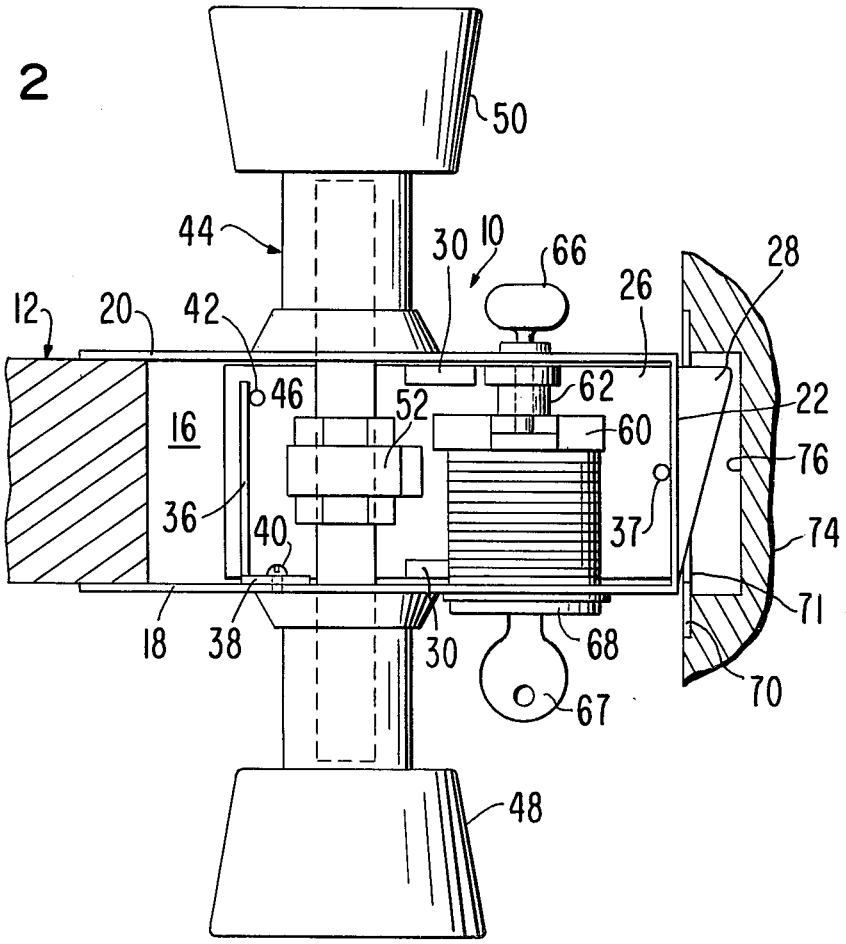
FIG. 2 is a top plan view of the lock of FIG. 1.

Means for holding lock bolt 26 in the full line position of FIGS. 1 and 2 includes an arm 60 mounted on a shaft 62 rotatably mounted on and extending inwardly from side 20. The outer end of arm 60 engages an end face 64 formed in lock bolt 26 by drilling a hole through the lock bolt. By rotating shaft 62 in a counterclockwise sense when viewing FIG. 2, arm 60 will rotate from right to left and thereby allow movement of lock bolt 26 to the left. From the inside, lock knob 66 is used to rotate shaft 62. From the outside, a cylinder lock 68 actuated by a key 67 is used.

In use, lock 10 is mounted on door 12 in the manner shown in FIGS. 1 and 2. It is used in conjunction with a door strike 70 mortised in the jamb face 72 of a fixed jamb 74 so that there is a recess 76 formed in the jamb face. When the door is locked, outer end 28 of lock bolt 26 is in recess 76 as shown in FIG. 1. Also, arm 60 is in the dashed line position of FIG. 1. When it is decided to open the door, arm 60 is rotated in a counterclockwise sense when viewing FIG. 1 either by rotating knob 66 or by actuation of lock 68 with key 67. When this occurs, the outer end of arm 60 moves away from face 64 and allows lock bolt 26 to move from right to left. Then, by rotating shaft 46 by either knob 48 or knob 50, lock bolt 26 is moved from right to left and out of recess 76 and out of the hole through door strike 70. Then the door can be opened.

Figure 3:
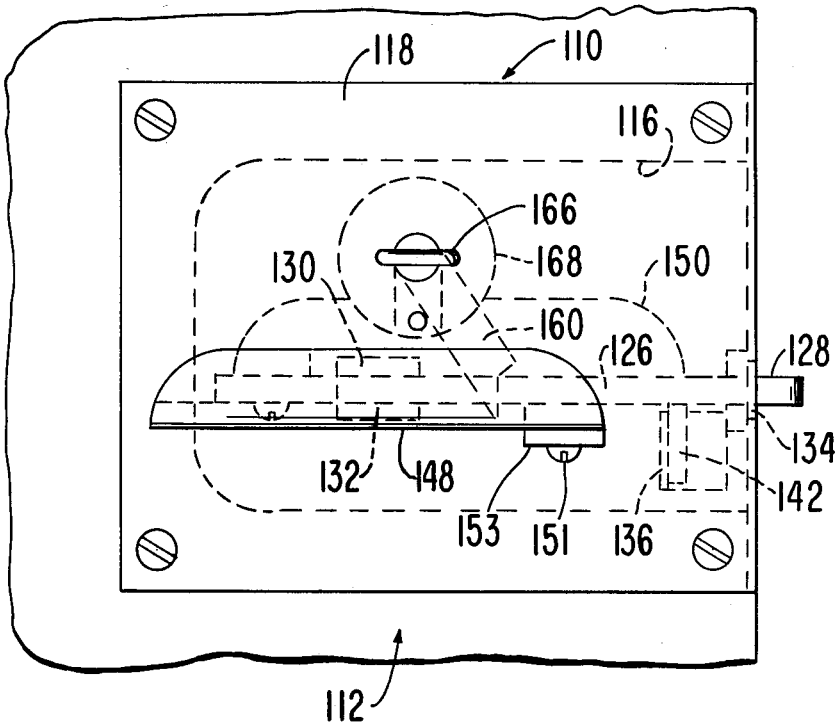
FIG. 3 is a view similar to FIG. 1 but showing a second embodiment of the lock of this invention.
Figure 4:
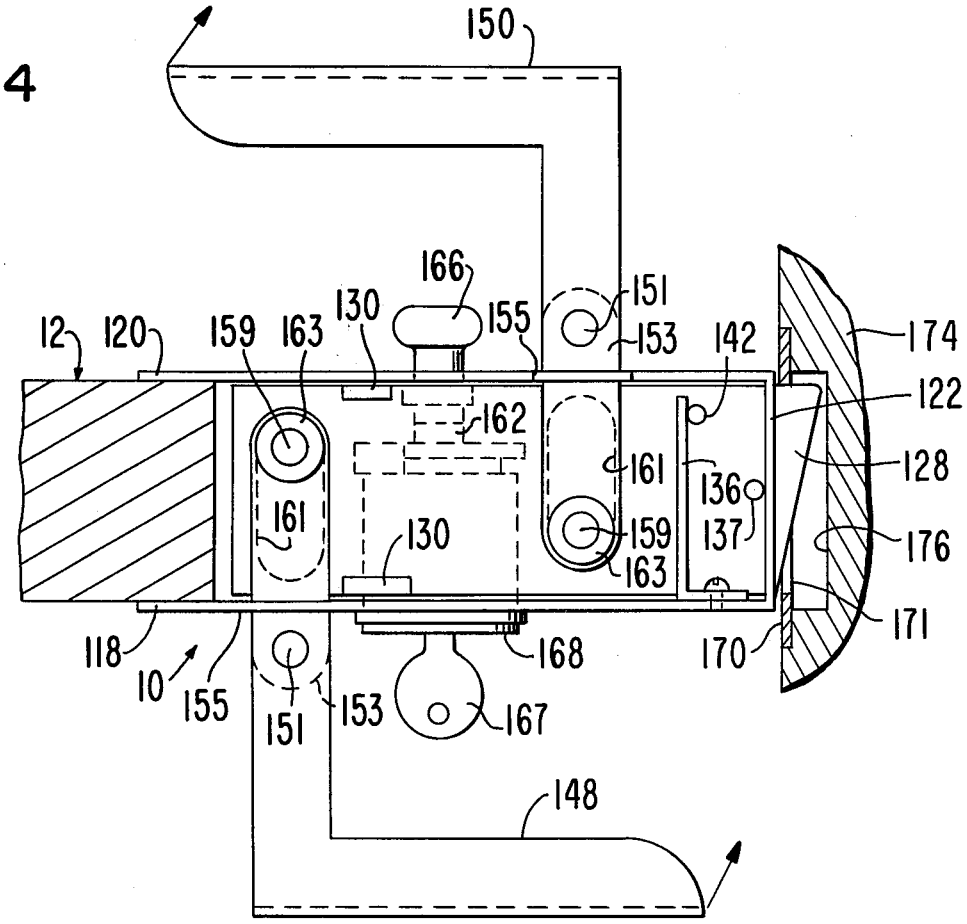
FIG. 4 is a view similar to FIG. 2 but showing a top plan view of the lock of FIG. 3.

FIGS. 3 and 4 show a second embodiment 110 of the lock of this invention. It includes a pair of spaced sides 118 and 120 and an end wall 122 for enclosing a recess 116 formed in the end of the door. It has a movable lock bolt 126 mounted by side guides 130 and 132 to allow limited movement of lock bolt 126. A stop 137 limits the outward travel of the outer end 128 of the bolt. A leaf spring 136 engaging a projection 142 biases lock bolt 126 outwardly, the base 138 of spring 136 being secured by a screw 140 to the inner surface of side 118. End wall 122 has an opening 134 to allow lock bolt 126 to pass therethrough.

Means is provided to hold the lock in its locked position shown in FIG. 3. To this end, an arm 160, similar to arm 60 of lock 10, is provided on a shaft 162. On the inside of the door, a latch knob 166 is provided to rotate shaft 162 in a clockwise sense when viewing FIG. 4 so that arm 160 will move from the position of FIG. 4 to a retracted or unlocked position, permitting movement of lock bolt 126 from right to left when viewing FIG. 4. From the outside of the door, rotation of shaft 162 can be accomplished by a key 167 in a cylinder lock 168.

Lock 110 does not have knobs as shown in FIG. 1 but instead has L-shaped levers 148 and 150. Each lever is pivotally mounted by a pin 151 on an ear 153 projecting laterally from the corresponding side 118 or 120. Each of sides 118 and 120 has a milled slot 155 for each lever, respectively, so that an inner segment 157 of the corresponding lever can extend into recess 116. The inner end of segment 157 has a pin 159 mounting a roller 163 received within a slot 161 formed through lock bolt 126. In this way, by pushing inwardly on lever 148 or pulling outwardly on lever 150, lock bolt 126 is caused to move from right to left when viewing FIG. 3 or FIG. 4.

In use, lock 110 is used with a door strike 170 mounted on the jamb face 172 of a door jamb 174, the latter having a mortised recess 176 and door strike 170 having an opening 171 to receive outer end 128 of lock bolt 126. Assuming the lock is in the position of FIGS. 1 and 2, lock bolt 126 is unlocked by rotating arm 160 in a clockwise sense when viewing FIG. 4. Then, by pulling on lever 150 or pushing on lever 148, lock bolt 126 is moved from right to left and outer end 128 moves out of recess 176 and out of opening 171 of door strike 170. Thus, the door can be opened. By releasing either lever, 148 or 150, spring 136 returns the lock bolt to the position shown in FIG. 3 and can move back into recess 176 once again when the door is closed.

A third embodiment 210 of the lock of this invention includes a pair of spaced parallel sides 218 and 220 and an end 222. A lock bolt 226 is mounted by guides 230 and 232 for slidable movement into and out of the position shown in FIGS. 5 and 6. End wall 222 has an opening therethrough to allow the outer end 228 of lock bolt 226 to project laterally therefrom and into a recess 276 formed in a door jamb 274 having a door strike 270. The door strike has an opening 271 therethrough for receiving outer end 228. A leaf spring 236 engaging a projection 242 on lock bolt 226 baises the latter into the position shown in FIGS. 5 and 6. An arm 260 carried on a shaft 262 can move into a position shown in FIG. 6 in which it holds lock bolt 226 in the locked position thereof shown in FIGS. 5 and 6. The arm 260 can be rotated by an inside latch knob 266 or by the rotation of a key 267 in a lock 268 accessible from the outside of the door.

A shiftable plate 247 extends through sides 218 and 220 and has an outer segment 248 and an inner segment 250, both segments having vertical end parts 251 which can be manually grasped. Plate 247 has a pin 253 provided with a roller 255 which is received within a slot 257 of the shape shown in FIG. 5. The slot has an inclined edge 259 which engages roller 255 so that a camming action is provided when segment 248 is pulled outwardly or segment 250 is pushed inwardly toward the door.

In operation, when lock 210 is mounted on door 212, and assuming lock bolt 226 and arm 260 are in the positions shown in FIGS. 5 and 6, the user will cause rotation of arm 260 by operation of latch knob 266 or by operation of lock 268. When this occurs, arm 260 rotates in a counterclockwise sense when viewing FIG. 6, thereby enabling lock bolt 226 to be moved from right to left. Then, segment 248 is pulled outwardly of the door or segment 250 is pushed inwardly toward the door, causing roller 255 to move along inclined edge 259 of slot 257. This cams lock bolt 226 inwardly of recess 216 and outer end 228 of lock bolt 226 moves out of recess 276 and out of opening 271 of door strike 270. Then the door can be opened. Spring 236 returns lock bolt 226 and segments 248 and 250 to their original positions. By moving the door to a closed position, outer end 228 latches in recess 276.

Figure 7:
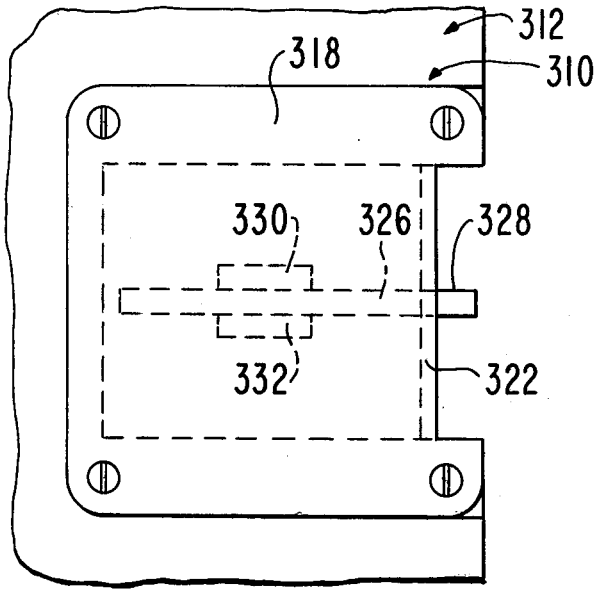
FIG. 7 is a view similar to FIGS. 2, 4 and 6 but showing a fourth embodiment of the lock for use with a door strike which needs no mortising.
Figure 8:
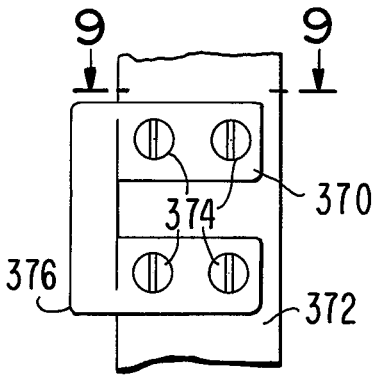
FIG. 8 is a side elevational view of the door strike suitable for use with the lock of FIG. 7.
Figure 9:
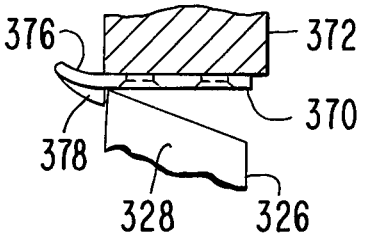
FIG. 9 is a cross-sectional view taken along line 9—9 of FIG. 8 and showing the lock bolt in coupled relationship to the door strike.

Another embodiment of the door lock of the present invention is shown in FIGS. 7–9 and is denoted by the numeral 310. It includes a pair of spaced sides, only one side 318 being shown, and an end wall 322, the end wall being spaced inwardly from the jamb face 313 of door 312 to present a recess 315. A lock bolt 326 is shiftably mounted by upper and lower guides 330 and 332 in the manner described above with respect to the other embodiments. The purpose of forming recess 315 is to accommodate a door strike 370 of the type shown in FIGS. 8 and 9, wherein the adjacent jamb 372 need not be mortised to mount strike 370. A number of screws 374 secure the door strike to the jamb. The door strike has a lateral projection 376 provided with a boss 378 (FIG. 9) for forming a stop for the outer end of lock bolt 326 as shown in FIG. 9. The mechanism for moving and holding lock bolt 326 can be selected from anyone of the three previous embodiments, namely, locks 10, 110 and 210. They have not been shown merely to simplify the drawings of FIGS. 7–9.

Figure 10:
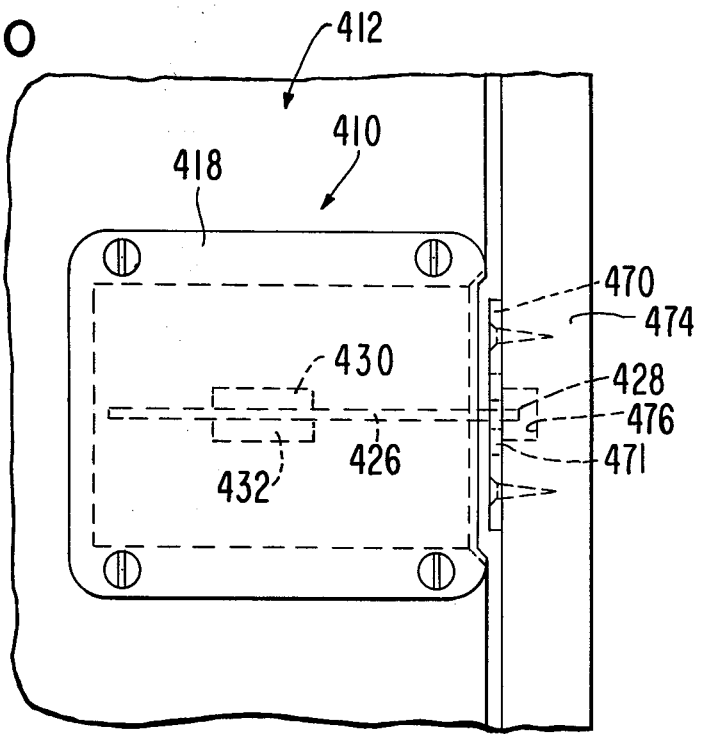
FIG. 10 is a view similar to FIGS. 2, 4, 6 and 7 but showing still another type of lock used with a door strike which needs no mortising.

FIG. 10 shows another embodiment 410 of the lock of this invention. It is very similar to the lock 310 except that it has a standard door strike 470 provided with a slot 471 in alignment with a mortised recess 476 in door jamb 474. The mechanism for moving and holding the corresponding lock bolt 426 can be anyone of those described above with respect to locks 10, 110 and 210.

I claim:

1. A lock for a door having a recess formed in the end thereof intermediate its top and bottom margins comprising: a U-shaped member having a pair of spaced sides and an end wall interconnecting the sides; means engageable with the sides for mounting the member on the door with the sides and end wall enclosing said recess, said end wall having an opening therethrough; a lock bolt having a pair of opposed side margins; means on the inner surfaces of the sides for mounting the side margins of the lock bolt in the space therebetween for movement from an extended, locked position with the ends of the lock bolt extending through and projecting laterally from the outer face of said end wall to a retracted, unlocked position with said one end of the lock bolt inwardly of the outer face of the end wall; means accessible from either side of said member and extending into the space between the sides for moving the lock bolt from said extended position to said retracted position; and means shiftably mounted on at least one of the sides within said space for releasably holding said lock bolt in said extended position.

2. A lock as set forth in claim 1, wherein said moving means includes a shaft rotatably mounted on and extending through said sides, said shaft having an arm projecting laterally therefrom in said space, the lock bolt having a recess formed therein, the outer end of the arm extending into the recess, the axis of rotation of the shaft being laterally spaced from the lock bolt and extending transversely of the path of travel thereof.

* * * * *